United States Patent [19]

Rensen

[11] Patent Number: 4,917,838

[45] Date of Patent: Apr. 17, 1990

[54] METHOD OF MANUFACTURING GREEN BRICKS WITH SMOOTH SIDE SURFACES

[75] Inventor: Henricus G. R. Rensen, Bemmel, Netherlands

[73] Assignee: Machinefabriek De Boer B.V., Nijmegen, Netherlands

[21] Appl. No.: 409,286

[22] Filed: Sep. 19, 1989

Related U.S. Application Data

[60] Continuation of Ser. No. 147,496, Jan. 25, 1988, abandoned, which is a division of Ser. No. 59,009, Jun. 8, 1987, Pat. No. 4,832,587.

[30] Foreign Application Priority Data

Jun. 25, 1986 [NL] Netherlands ..... 8601671

[51] Int. Cl.[4] ..... B28B 3/06; B28B 5/00; B28B 7/10; B28B 7/36

[52] U.S. Cl. ..... 264/39; 264/297.6; 264/297.7; 264/336; 264/338

[58] Field of Search ..... 264/39, 336, 338, 297.6, 264/297.7; 425/99, 101, 220, 230, 231, 253, 254, 255, 443, 452

[56] References Cited

U.S. PATENT DOCUMENTS

| | | | |
|---|---|---|---|
| 750,059 | 1/1904 | Oberdahn | 425/99 |
| 1,082,231 | 12/1913 | Nale | 264/338 X |
| 1,331,323 | 2/1920 | Crouch . | |
| 1,435,569 | 10/1973 | Glendinning | 425/99 |
| 1,529,453 | 3/1925 | Strickland | 425/99 |
| 1,529,692 | 3/1925 | Davis et al. | 264/39 X |
| 2,716,070 | 8/1955 | Seipt | 264/39 |
| 3,739,050 | 6/1973 | Koncz et al. | 264/39 |
| 3,974,247 | 8/1976 | Tardieu | 264/336 X |
| 4,378,202 | 3/1983 | Kosman | 425/99 |

FOREIGN PATENT DOCUMENTS

| | | | |
|---|---|---|---|
| 659949 | 4/1938 | Fed. Rep. of Germany . | |
| 2492808 | 10/1980 | France . | |
| 753 | 12/1912 | Netherlands . | |
| 128758 | 12/1969 | Netherlands . | |
| 303203 | 2/1955 | Switzerland . | |
| 2106825 | 4/1983 | United Kingdom | 264/39 |

*Primary Examiner*—Jan H. Silbaugh
*Assistant Examiner*—Karen Kutach
*Attorney, Agent, or Firm*—Webb, Burden, Ziesenheim & Webb

[57] ABSTRACT

A method of manufacturing bricks with smooth surfaces includes the steps of providing a mould container with a movable bottom, washing the mould container, placing a layer of releasing material in the mould container, filling the mould container with clay and trimming off the container. Only the bottom of the container is filled with a releasing material and the bottom of the container is moved so that it is virtually outside of the mould container.

1 Claim, 3 Drawing Sheets

Figure 1:
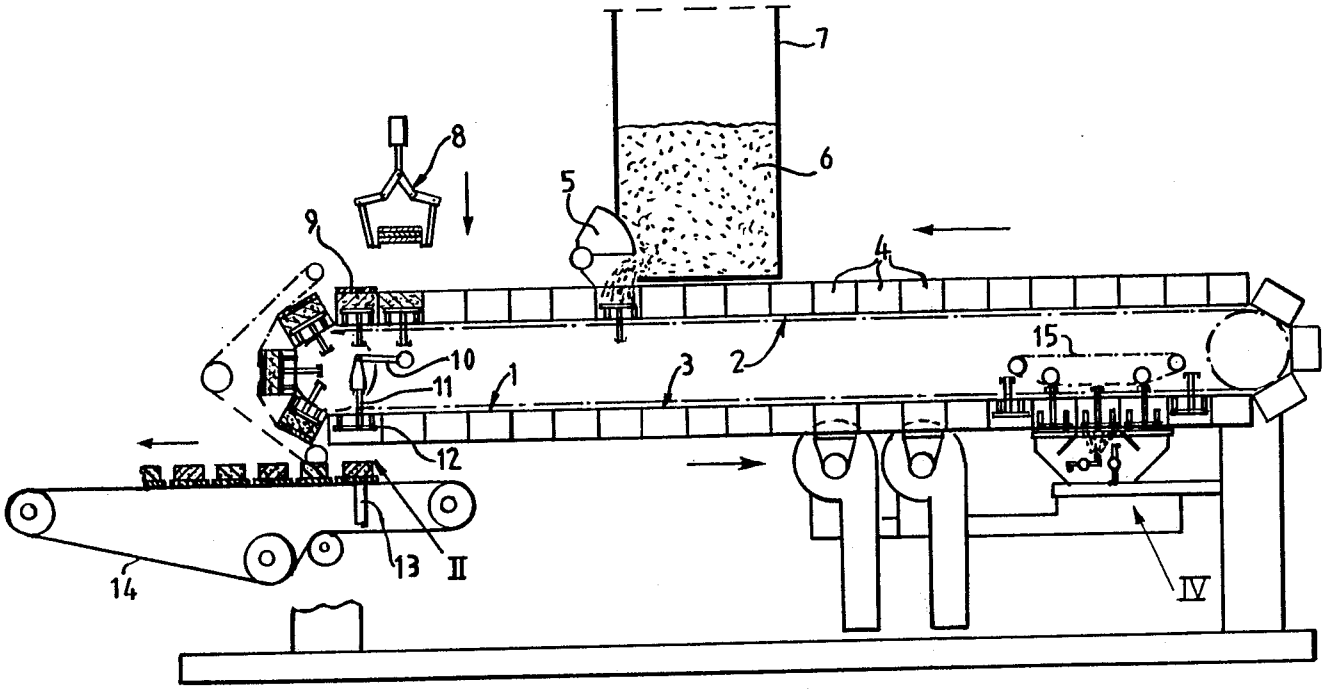

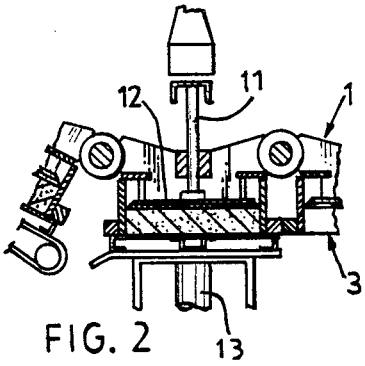
FIG. 2
FIG. 3
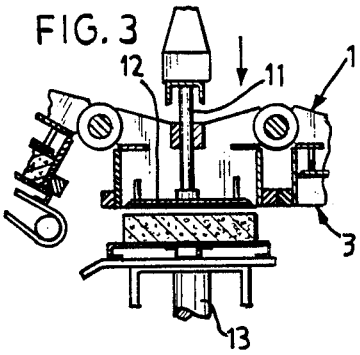
FIG. 6
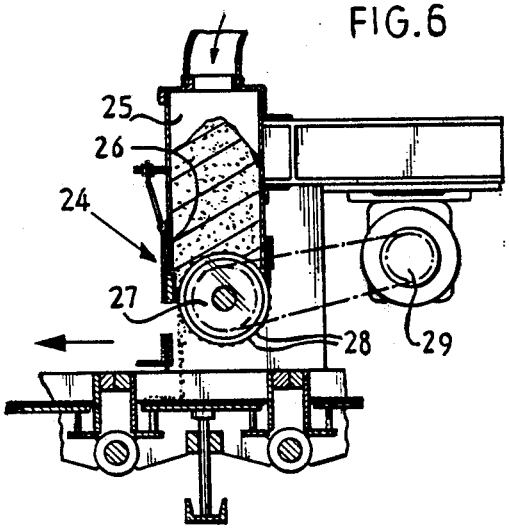
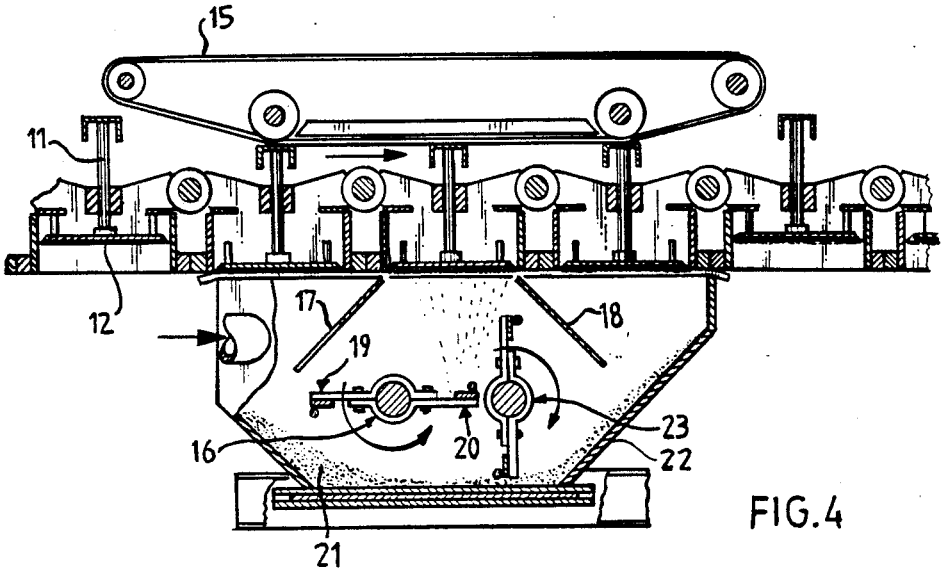
FIG. 4

METHOD OF MANUFACTURING GREEN BRICKS WITH SMOOTH SIDE SURFACES

This is a continuation of copending application Ser. No. 07/147,496 filed Jan. 25, 1988, now abandoned, which in turn was a divisional application of Ser. No. 07/059,009 filed June 8, 1987, U.S. Pat. No. 4,832,587, for "Method and Device for Manufacturing Bricks".

The invention relates to a method and device for manufacturing bricks with smooth side surfaces.

The mechanical manufacture of bricks with smooth side surfaces, so-called "Wasserstrichsteine" is not possible with the existing methods and on existing belt moulding-mould container machines. The problem is the discharging of the green brick out of the mould container. Since the side surfaces have to be smooth no releasing material can be used here for this purpose.

The invention has for its object to obviate this drawback and to enable the manufacture of said bricks on existing belt moulding systems. In accordance with the present invention the mould container is provided with a movable bottom. The mould container is washed, a layer of releasing material is placed in the container, and the container is filled with clay and trimmed off. In particular, only the bottom of the mould container is provided with the releasing material and the bottom is then moved so that it is virtually outside of the mould container. The device includes a circulating conveyor for supplying mould containers, a holder for releasing material, a holder for clay, means for carrying clay out of the holder and into the mould container, means for pressing the clay and trimming the mould container, and means for placing a drying plate onto the filled mould container. The device also includes a mechanism for displacing the bottom of the mould container and a mechanism for throwing up releasing material.

Since the bottom of the mould container is moved so as to be virtually outside the mould container, it is sufficient to have releasing material only on the bottom of the mould container. The friction force occurring between the walls of the mould container and the green brick are overcome by the outward pressure force applied to the bottom. Sand or sawdust, for example, can be used as releasing material.

The invention is elucidated with reference to the annexed drawings of an embodiment.

Figure 5:
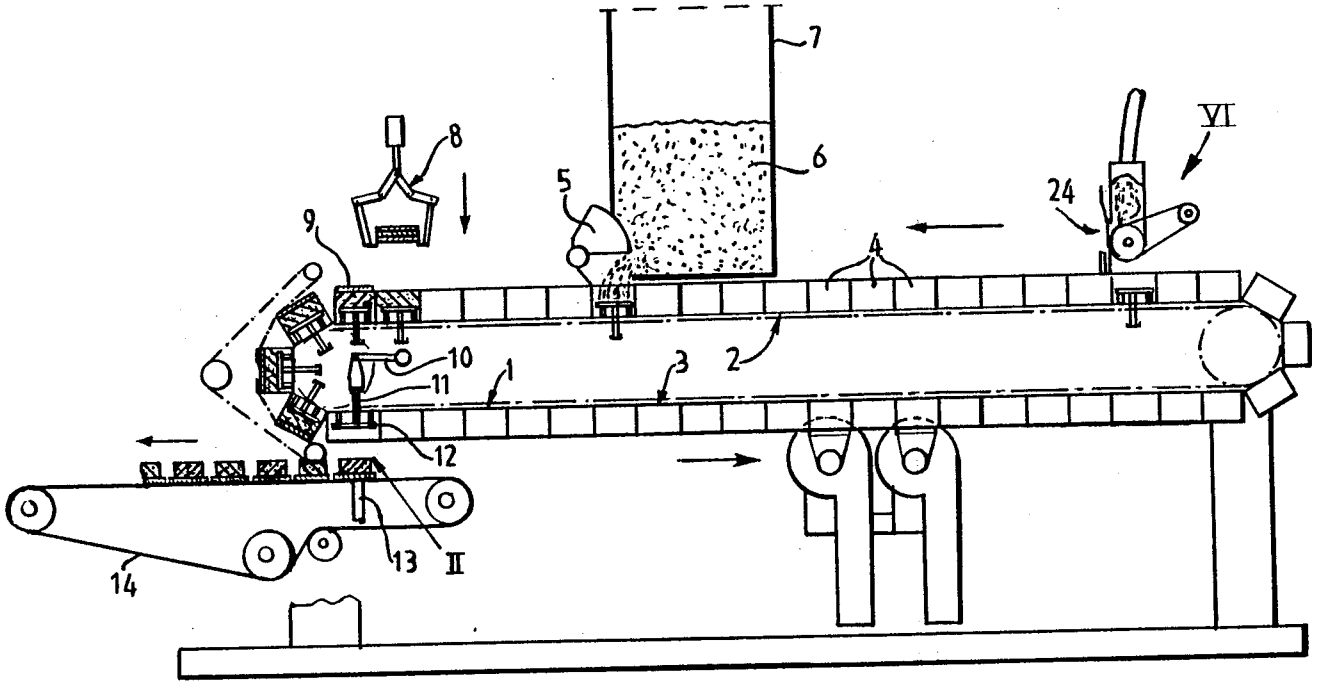

In the drawings:

FIG. 1 shows a side view in diagrammatic form of the device for use with the method according to the invention, FIGS. 2 and 3 show the pressing out of the bottom in the device as in FIG. 1, FIG. 4 is a view on a larger scale of the part IV from FIG. 1, FIG. 5 shows an alternative embodiment, and FIG. 6 is detail VI from FIG. 5 on a larger scale.

The device according to the invention comprises a conveyor 1 which transports mould containers 4 in a circulating path consisting of an upper part 2 and a lower part 3. Using the press-on and trimming member 5 clay 6 is carried from holder 7 into the mould container. A gripper device 8 places a carrying plate 9 onto the filled mould container. Using the press-out mechanism 10 and the base shaft 11 attached to bottom 12, the bottom 12 is pressed outside mould container 4. As a result the green brick, carried by carrying plate 9, comes onto a support member 13 which then transfers the green brick to the conveyor 14.

Care should be taken in performing the method that only the bottom of the mould container is provided with releasing material, for example sand or sawdust. Present for this purpose is a control mechanism in the form of a circulating belt 15, which moves the base shaft 11 and therefore the bottom 12 outward in the proximity of the throw-up mechanism 16. At this location (FIG. 4) the bottom 12 is virtually flush with the upper surface of mould container 4. Arranged close to throw-up mechanism 16 are two guide plates 17 and 18. The throw-up mechanism consists of a pair of rotating arms 19 and 20 which move through the supply of releasing material 21 in container 22. As a result of the rotation movement the releasing material is thrown upward and, guided by guide plates 17 and 18, carried onto bottom 12. Because the mould container is first washed with water, the releasing material remains adhered to the bottom. The walls of the mould container are very moist as excessive water is used to rinse the mould container.

It is noted that two throw-up arms 16 and 23, which function in identical manner, are drawn in FIG. 4.

Since according to the invention the walls of the mould container are kept very moist there results a green brick with smooth side walls when pressing out takes place, the green brick releasing easily from the bottom as a result of the presence of releasing material on the bottom of the mould container.

FIG. 5 shows a second embodiment of the invention. By means of the dosing device 24 releasing material from a reservoir 25 is placed on the bottom of the mould container. A dosing device consists of a roller 27 rotating in the close proximity of the wall 26 of reservoir 25, the roller being provided on its surface with ribs 28 positioned at an interval from one another. The releasing material falls in a narrow band onto the bottom of the mould container while the latter moves beneath the slit-like opening between wall 26 and roller 27. Setting a dosing into operation at the right moment by driving the roller 27 for rotation from the driving disc 29 ensures that the releasing material is applied only to the bottom of the mould containers, while the walls of the mould container remain unaffected.

I claim:

1. Method for manufacturing green bricks with smooth side surfaces, using a mould container with side walls and a movable bottom, comprising washing said mould container with excess water such that said side walls of said mould container are moistened, and while keeping said side walls moist placing a releasing material layer of sand or sawdust only on said movable bottom and then filling said mould container with clay, then trimming excess clay from said mould container, and moving said bottom so that it is virtually outside said mould container while said side walls are kept moist to form a green brick with smooth side surfaces due to the absence of said releasing material layer on said moist side walls.

* * * * *